US009610466B2

(12) United States Patent
Burkhart et al.

(10) Patent No.: US 9,610,466 B2
(45) Date of Patent: Apr. 4, 2017

(54) CONTROLLED DISCHARGE GAS VENT

(71) Applicants: David J. Burkhart, Wentzville, MO (US); Jeffrey T. Kochelek, Creve Coeur, MO (US); Kenneth Jones, Chesterfield, MN (US); Thorstein Holt, Glencoe, MO (US)

(72) Inventors: David J. Burkhart, Wentzville, MO (US); Jeffrey T. Kochelek, Creve Coeur, MO (US); Kenneth Jones, Chesterfield, MN (US); Thorstein Holt, Glencoe, MO (US)

(73) Assignees: Engineered Corrosion Solutions, LLC, St. Louis, MO (US); Holtec Gas Systems, LLC, Chesterfield, MO (US)

( * ) Notice: Subject to any disclaimer, the term of this patent is extended or adjusted under 35 U.S.C. 154(b) by 0 days.

(21) Appl. No.: 14/225,819

(22) Filed: Mar. 26, 2014

(65) Prior Publication Data

US 2014/0202714 A1 Jul. 24, 2014

Related U.S. Application Data

(62) Division of application No. 12/606,287, filed on Oct. 27, 2009, now Pat. No. 8,720,591.

(51) Int. Cl.

| | |
|---|---|
| ***A62C 35/62*** | (2006.01) |
| ***A62C 35/64*** | (2006.01) |
| ***A62C 35/68*** | (2006.01) |

(52) U.S. Cl.

CPC ..... *A62C 35/645* (2013.01); *A62C 35/62* (2013.01); *A62C 35/64* (2013.01); *A62C 35/68* (2013.01); *Y10T 137/3087* (2015.04)

(58) Field of Classification Search

CPC ..... A62C 35/62; A62C 35/64; A62C 35/645; A62C 35/68; Y10T 137/8634

See application file for complete search history.

(56) References Cited

U.S. PATENT DOCUMENTS

| | | | | |
|---|---|---|---|---|
| 1,459,594 A | | 6/1923 | McWhorter et al. | |
| 2,187,906 A | * | 1/1940 | Lowe | A62C 35/605 137/79 |

(Continued)

FOREIGN PATENT DOCUMENTS

| | | |
|---|---|---|
| CN | 102661287 A | 9/2012 |
| DE | 3938394 A1 | 5/1991 |

(Continued)

OTHER PUBLICATIONS

International Search Report (Form PCT/ISA/210) and Written Opinion of the International Searching Authority (Form PCT/ISA/237) from corresponding Patent Cooperation Treaty Application No. PCT/US2010/054108, mailed Jul. 27, 2011.

(Continued)

*Primary Examiner* — Ryan Reis

(74) *Attorney, Agent, or Firm* — Gardner, Linn, Burkhart & Flory, LLP

(57) ABSTRACT

A fire protection system includes a dry pipe system and a controlled discharge gas vent. The dry pipe system and controlled discharge gas vent operate using a breathing cycle to displace oxygen and/or water vapor from within the piping network of the dry pipe system. The controlled gas discharge vent allows displacement of pressurized air with nitrogen, for example, using manual or automated processes that can employ one or more sensors. Corrosion resulting from oxygen, water, and/or microbial growth is reduced or nearly eliminated.

42 Claims, 3 Drawing Sheets

(56) References Cited

U.S. PATENT DOCUMENTS

| | | | | |
|---|---|---|---|---|
| 2,627,868 | A | 2/1953 | Runnels | |
| 3,905,424 | A | 9/1975 | Elwood et al. | |
| 3,969,092 | A | 7/1976 | Huffman et al. | |
| 4,104,004 | A | 8/1978 | Graef | |
| 4,197,097 | A | 4/1980 | Magorien et al. | |
| 4,849,739 | A | 7/1989 | Loiacono | |
| 4,991,655 | A * | 2/1991 | McHugh | A62C 35/68 137/218 |
| 5,133,577 | A | 7/1992 | Schultze et al. | |
| 5,236,049 | A * | 8/1993 | Asselin | A62C 37/44 169/17 |
| 5,438,841 | A | 8/1995 | Cahill-O'Brien et al. | |
| 5,611,218 | A | 3/1997 | Naumovitz | |
| 5,799,735 | A | 9/1998 | Sundholm | |
| 5,803,180 | A | 9/1998 | Talley | |
| 5,845,714 | A | 12/1998 | Sundholm | |
| 6,024,116 | A | 2/2000 | Almberg et al. | |
| 6,076,278 | A | 6/2000 | Bradley | |
| 6,102,066 | A | 8/2000 | Craig et al. | |
| 6,221,263 | B1 | 4/2001 | Pope et al. | |
| 6,293,348 | B1 | 9/2001 | Reilly | |
| 6,343,615 | B1 * | 2/2002 | Miller | A62C 35/68 137/202 |
| 6,390,203 | B1 | 5/2002 | Borisov et al. | |
| 6,415,870 | B1 | 7/2002 | Matsuoka | |
| 6,443,173 | B1 | 9/2002 | Thompson, Jr. | |
| 6,540,028 | B2 | 4/2003 | Wood | |
| 6,578,602 | B1 * | 6/2003 | Kirschner | A62C 35/68 137/312 |
| 6,581,694 | B2 | 6/2003 | Golner et al. | |
| 6,601,653 | B2 | 8/2003 | Grabow et al. | |
| 6,666,277 | B2 | 12/2003 | Reilly | |
| 6,841,125 | B1 | 1/2005 | Chartier et al. | |
| 6,926,023 | B2 * | 8/2005 | Cabral | F17D 5/02 137/199 |
| 6,960,321 | B1 | 11/2005 | Ludwig | |
| 7,066,186 | B2 | 6/2006 | Bahr | |
| 7,104,336 | B2 | 9/2006 | Ozment | |
| 7,124,834 | B2 | 10/2006 | Sundholm et al. | |
| 7,322,423 | B2 | 1/2008 | Ringer | |
| 7,389,824 | B2 * | 6/2008 | Jackson | A62C 3/004 137/79 |
| 7,594,545 | B2 | 9/2009 | Love | |
| 7,644,775 | B2 | 1/2010 | Sundholm | |
| 7,673,694 | B2 | 3/2010 | Wagner et al. | |
| 7,712,542 | B2 | 5/2010 | Munroe | |
| 7,717,776 | B2 | 5/2010 | Wagner et al. | |
| 7,845,424 | B1 | 12/2010 | Miller | |
| 7,921,577 | B2 | 4/2011 | Reilly et al. | |
| 8,105,051 | B2 | 1/2012 | Kusay et al. | |
| 8,122,968 | B2 | 2/2012 | Johnson | |
| 8,132,629 | B2 | 3/2012 | Reilly et al. | |
| 8,636,023 | B2 | 1/2014 | Burkhart et al. | |
| 8,720,591 | B2 | 5/2014 | Burkhart et al. | |
| 9,186,533 | B2 | 11/2015 | Kochelek et al. | |
| 2006/0021759 | A1 | 2/2006 | Golinveaux | |
| 2007/0000258 | A1 | 1/2007 | Bonaquist et al. | |
| 2007/0034256 | A1 | 2/2007 | Ramoth | |
| 2007/0114046 | A1 | 5/2007 | Munroe | |
| 2008/0060215 | A1 | 3/2008 | Reilly et al. | |
| 2008/0060216 | A1 | 3/2008 | Reilly et al. | |
| 2008/0277125 | A1 * | 11/2008 | Wilkins | A62C 35/645 169/46 |
| 2009/0020166 | A1 | 1/2009 | McHugh, IV | |
| 2010/0065287 | A1 | 3/2010 | Burkhart et al. | |
| 2010/0263882 | A1 | 10/2010 | Bodemann | |
| 2011/0000685 | A1 | 1/2011 | Matsuoka | |
| 2011/0094758 | A1 | 4/2011 | Burkhart et al. | |
| 2011/0108123 | A1 | 5/2011 | Burkhart et al. | |
| 2011/0226495 | A1 | 9/2011 | Burkhart et al. | |
| 2013/0098640 | A1 | 4/2013 | Burkhart et al. | |
| 2014/0338928 | A1 | 11/2014 | Mortensen et al. | |

FOREIGN PATENT DOCUMENTS

| | | | |
|---|---|---|---|
| EP | 1074276 | A2 | 2/2001 |
| GB | 1081293 | | 8/1967 |
| JP | 10234881 | A | 9/1998 |
| JP | 2005002977 | A | 1/2005 |
| JP | 2006247237 | A | 9/2006 |
| JP | 3928201 | B2 | 6/2007 |
| JP | 2008073227 | A | 4/2008 |
| WO | 2009106806 | A1 | 9/2009 |

OTHER PUBLICATIONS

International Preliminary Report on Patentability from corresponding Patent Cooperation Treaty Patent Application No. PCT/US2010/054108 mailed May 10, 2012.

Ansul Inc., AquasonicTM Water-Atomizing Fire Suppression System, Data/Specifications, 4 pgs., 2008.

Compressed Gas Technologies, Nitrogen Generator Specialists, 1 pg., 2009, Retrieved online on Mar. 27, 2009, at http://www.nitrogen-generators.com.

Engineered Corrosion Solutions, Ejector Automatic Air Vent product information, 3 pgs., Mar. 20, 2009.

Engineered Corrosion Solutions, Ejector Automatic Air Vent product information, 3 pgs., Jul. 15, 2008.

General Air Products, Desiccant Dryers, 2 pgs., Retrieved online on Mar. 27, 2009, at http://www.generalairproducts.com/pages2/desiccant-dryers.html.

General Air Products, Dry Air Pac FM Approved Compressor Dryer Package for Critical Applications from Generators, 4 pgs., 2009, Retrieved online on Mar. 27, 2009, at http://www.generalairproducts.com/fireprotection/content/view/16/88/.

O'Keefe Controls Co., Metal Orifice Assemblies product information, 6 pgs., 2006.

On Site Gas Systems, 2 pgs., 2009, Retrieved online on Mar. 27, 2009, at http://www.onsitegas.com.

Potter Electric Signal, Sprinkler Monitoring Training Manual, National Fire Protection Association (NFPA) and National Electrical Manufacturers Association [NEMA], 46 pgs., Retrieved online on Mar. 27, 2009, at http://pottersignal.com/sprinkler_datasheets.aspx.

Office Action issued Dec. 19, 2012, for European Patent Application No. 09792263.7 entitled Fire Protection Systems Having Reduced Corrosion.

Petitioners' Motion to File Supplemental Information Pursuant to 37 C.F.R. § 42.123, Jun. 27, 2016, 8 pages.

Patent Owner Engineered Corrosion Solutions, LLC's Opposition to Petitioners' Motion to Submit Supplemental Information, Jul. 5, 2016, 7 pages.

Order Denying Petitioner's Motion to File Supplemental Information 37 C.F.R. § 42.123(a), Aug. 3, 2016, 8 pages.

Patent Owner Engineered Corrosion Solutions, LLC's Response to Petition, Aug. 26, 2016, 65 pages.

Petition for Inter Partes Review of U.S. Patent No. 9,186,533 Pursuant To 35 U.S.C. §§ 311-319, 37 C.F.R. § 42, Jul. 1, 2016, 66 pages.

Patent Owner Engineered Corrosion Solutions, LLC's Preliminary Response, Oct. 26, 2016, 39 pages.

NFPA 13 Standard for the Installation of Sprinkler Systems, 2007, pp. 1-408.

Plant Layup and Equipment Preservation Sourcebook, Mar. 1987, pp. 1-196.

Declaration of Robert S. O'Neill, P.E., Aug. 26, 2016, 24 pages.

Petition for Inter Partes Review of U.S. Patent No. 9,144,700 Pursuant to 35 U.S.C. §§ 311-319, 37 C.F.R. § 42, Nov. 19, 2015, 36 pages.

Patent Owner Engineered Corrosion Solutions, LLC's Preliminary Response, Feb. 24, 2016, 49 pages.

Decision Institution of Inter Partes Review 37 C.F.R. § 42.108, May 12, 2016, 18 pages.

(56) References Cited

OTHER PUBLICATIONS

Patent Owner Engineered Corrosion Solutions, LLC's Request for Rehearing Under 37 C.F.R. § 12.71(d), May 26, 2016, 14 pages.

* cited by examiner

CONTROLLED DISCHARGE GAS VENT

CROSS REFERENCE TO RELATED APPLICATION

The present application is a division of U.S. patent application Ser. No. 12/606,287, filed Oct. 27, 2009, the disclosure of which is hereby incorporated herein by reference in its entirety.

INTRODUCTION

The present technology relates to a vent and venting methods for the controlled discharge of gas, where the vent and methods can be used in a fire protection system and can operate to automatically vent a dry pipe or preaction system.

A fire protection system, also known as a fire suppression or fire sprinkler system, is an active fire protection measure that includes a water supply to provide adequate pressure and water flow to a water distribution piping system, where water is discharged via sprinklers or nozzles. Fire protection systems are often an extension of existing water distribution systems, such as a municipal water system, water well, water storage tank, or reservoir. Fire protection systems can be separated into two general types, wet pipe systems that include a piping network prefilled with water, and dry pipe systems that include at least a portion of the piping network filled with air/gas instead of water.

Dry pipe sprinkler systems can be used where the fire protection system may be exposed to freezing temperatures. A typical dry pipe sprinkler system includes a preaction/dry pipe sprinkler network containing a plurality of normally closed sprinkler heads. The sprinkler network is connected via a piping system to a dry pipe valve or primary water supply valve which has a dry output side facing the piping system and a wet input side facing a pressurized source of water. In standby operation, the piping system and sprinkler network are filled or charged with a gas, such as air, which may be pressurized. Industrial dry pipe systems generally charge the piping system lines to about 25 to 50 psig. The sprinkler heads typically include normally closed temperature-responsive elements.

If heated sufficiently, the normally closed element of the sprinkler head opens, allowing pressurized gas to escape from the piping system. As gas pressure in the fluid flow lines drops below a predetermined value, a mechanism causes the dry pipe valve to open. Pressurized water then flows into the piping system, displacing the gas, and exits through the open sprinkler head to extinguish the fire or smoke source. Water flows through the system and out the open sprinkler head, and any other sprinkler heads that subsequently open, until the sprinkler head closes itself, if automatically resetting, or until the water supply is turned off.

There are a number of different mechanisms and techniques for causing a dry pipe sprinkler system to go "wet;" i.e., to cause the primary water supply valve to open and allow the water to fill the piping system lines. In one mechanism, after a sprinkler head opens, the pressure difference between the gas pressure in the piping system and the water supply pressure on the wet side of the primary water supply valve must reach a specific hydraulic imbalance before the primary water supply can open.

Maintenance of the air or gas pressure in the fluid flow lines is important for proper operation of the dry pipe system. On one hand, if gas pressure drops too low, for example, where there is a leak in the piping system, the dry pipe valve may be unable to maintain the specific hydraulic balance necessary to prevent the dry pipe valve from opening and allowing water to enter the piping system. The system must then be drained and recharged. On the other hand, if the pressure is too high in the piping system, there may be a significant delay in opening the dry pipe valve to allow water to enter the fluid flow lines and reach one or more sprinklers, as the excess pressure must be vented prior to opening the water supply. Dry pipe sprinkler systems can also suffer from false alarms from ambient temperature-induced expansion and contraction of the pressurized air within the fluid flow lines. For example, the pressurized gas may contract to a degree that triggers opening of the primary water valve.

SUMMARY

The present technology includes various apparatuses and methods for venting and controlling corrosion in fire protection systems. Embodiments include controlled discharge gas vents that comprise a liquid sensing valve having (1) an inlet and an outlet, (2) a back pressure regulator having an inlet and an outlet, and (3) an orifice having an inlet and an outlet, operable to provide a flow rate of gas therethrough. The inlet of the back pressure regulator is coupled to the outlet of the liquid sensing valve. The inlet of the orifice coupled to the outlet of the back pressure regulator. The vent may include one or more sensors, such as an oxygen sensor and/or a humidity sensor. The back pressure regulator may be operable to continuously provide a low flow of gas to the orifice and provide a high flow of gas to the orifice upon reaching a pressure threshold. The pressure threshold may be adjustable.

Embodiments also include fire protection systems that comprise a sprinkler system and a source of pressurized gas coupled to the sprinkler system. The sprinkler system comprises at least one sprinkler, a source of pressurized water, a piping network connecting the at least one sprinkler to the source of pressurized water, and a controlled discharge gas vent. The sprinkler system may be a dry pipe system or a preaction system. And the source of pressurized gas may be provided by an air compressor and/or a nitrogen generator.

Embodiments further include methods of reducing corrosion in a fire protection system. The piping network of the sprinkler system is pressurized with the source of pressurized gas to provide a pressure that prevents the dry pipe valve from opening or maintains the amount of pressurized gas in a preaction system to supervise the integrity of the piping network. The pressure is further increased using the source of pressurized gas to exceed a threshold pressure of the back pressure regulator of the controlled discharge gas vent, where the threshold pressure of the back pressure regulator is greater than the pressure that prevents the dry pipe valve from opening. The pressurized gas is then vented via the controlled discharge gas vent by opening of the back pressure regulator until the pressure of the piping network is below the threshold pressure of the back pressure regulator, whereupon the back pressure regulator closes.

The pressure within the piping network may be increased another time, causing the pressure to again exceed the threshold pressure of the back pressure regulator of the controlled discharge gas vent. The pressurized gas is then vented via the controlled discharge gas vent by opening of the back pressure regulator until the pressure of the piping network is below the threshold pressure of the back pressure regulator. These pressurization and depressurization cycles ("breathing" cycles) may be repeated so that the pressurized gas, which may be compressed air and/or nitrogen for example, effectively displaces substantially all the humidified air/moisture and/or oxygen within the piping network.

DRAWINGS

The present technology will become more fully understood from the detailed description and the accompanying drawings.

Figure 1:
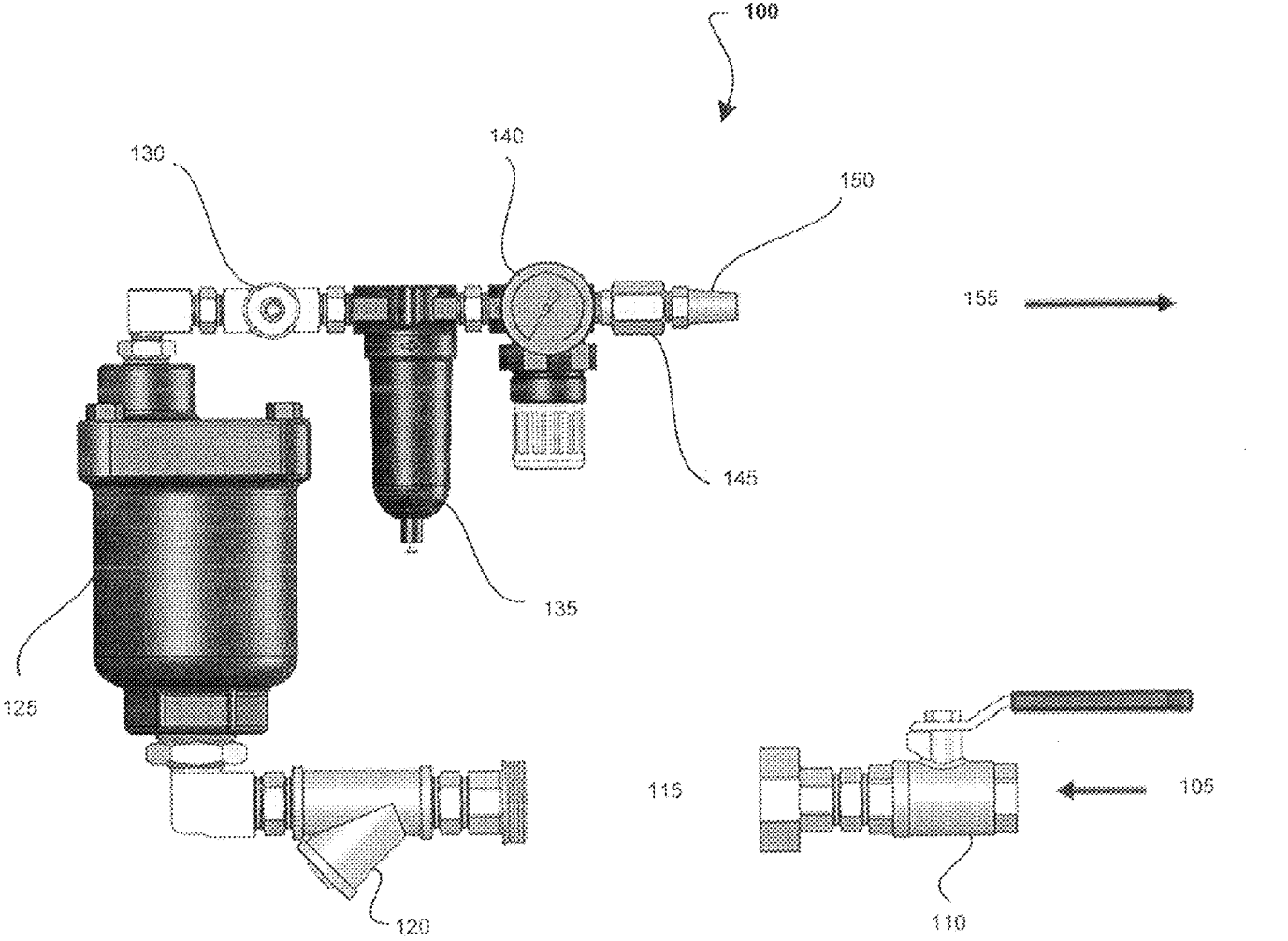
FIG. 1 illustrates an embodiment of a controlled discharge gas vent constructed according to the present disclosure.

It should be noted that the figures set forth herein are intended to exemplify the general characteristics of apparatus, systems, and methods among those of the present technology, for the purpose of the description of specific embodiments. These figures may not precisely reflect the characteristics of any given embodiment, and are not necessarily intended to define or limit specific embodiments within the scope of this technology.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

The headings (such as "Introduction" and "Summary") and sub-headings used herein are intended only for general organization of topics within the present disclosure, and are not intended to limit the disclosure of the technology or any aspect thereof. In particular, subject matter disclosed in the "Introduction" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the apparatus and systems of this technology and, unless explicitly stated otherwise, are not intended to be a representation that given embodiments of this technology have, or have not, been made or tested.

As used herein, the word "include," and its variants, is intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

"A" and "an" as used herein indicate "at least one" of the item is present; a plurality of such items may be present, when possible. "About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. In addition, disclosure of ranges includes disclosure of all distinct values and further divided ranges within the entire range.

The present technology relates to a controlled discharge gas vent that can be used as an automatic vent in a dry pipe or preaction fire sprinkler system. The vent can provide for the controlled discharge of gas from pressurized fire sprinkler system piping, such as employed in dry pipe or preaction sprinkler systems. In some aspects, the controlled discharge gas vent can allow for progressive displacement of pressurized gas initially contained in a fire sprinkler system piping network with another gas. For example, pressurized air may be displaced with a drier pressurized gas, i.e., a gas having a lower water vapor content, such as dehumidified air or dry nitrogen gas produced from a nitrogen generator, for example, as disclosed by International Application No. PCT/US09/56000, Burkhart et al., filed Sep. 4, 2009. The controlled discharge gas vent may also be used to provide the controlled discharge of any gas for displacement with another gas while maintaining an acceptable pressure within a system that is being vented.

Aspects of the controlled discharge gas vent can provide for precise release of a quantifiable amount of gas at a known rate of discharge over time within a given pressure range. This is accomplished through the use of one or more vents including particular orifices that may be located at various locations within the fire sprinkler system piping network, for example. These discharge orifices may comprise particular machined metallic orifices having specific apertures. In some configurations, gas is discharged from a pipe or piping network having an internal pressure higher than atmospheric pressure (14.7 psi) to atmospheric pressure at the discharge orifice. The pressure drop may be determined at the discharge orifice. With a known differential pressure and a known orifice diameter, it is possible to determine the amount of gas that will be discharged per unit of time, typically in standard cubic feet per minute.

The controlled discharge gas vent may be used as part of a fire protection system, such as a dry pipe sprinkler system. Basically, there are two predominant types of automatic fire protection sprinkler systems—a wet pipe system wherein the piping leading from its water control valve to the sprinkler heads is normally filled with water, and a dry pipe system wherein the piping leading from its water control valve to the sprinkler heads is pressurized with a gas until the water control (dry pipe) valve, closing off the source of water from the system, is opened to introduce water into the piping leading to the sprinkler heads thereof. On one hand, wet pipe sprinkler systems offer the advantage of water being immediately discharged from an operated sprinkler. On the other hand, wet pipe sprinkler systems cannot be readily used in applications where there is a possibility that the system piping interconnecting the sprinkler(s) will be exposed to freezing temperatures. Accordingly, dry pipe sprinkler systems are normally used in applications where freezing temperatures may occur. Dry pipe sprinkler systems, however, have the drawback that because the piping system is normally filled with pressurized gas and not water, water is not immediately discharged from an operated sprinkler.

Sprinkler systems are preferably engineered to meet the standards of the National Fire Protection Association (Quincy, Mass. USA; see N.F.P.A. Pamphlet 13, "Standard for The Installation of Sprinkler Systems"), Factory Mutual (F.M.), Loss Prevention Council (Johnston, R.I., USA), Verband der Sachversicherer (Köln, Germany), or other similar organizations, and also comply with the provisions of governmental codes, ordinances, and standards where applicable.

In dry pipe sprinkler systems, when a sprinkler head is operated, a portion of the pressurized gas flows out through the opened sprinkler head, causing a decrease in the pressure of the gas in the piping system. When the pressure of the gas in the piping drops to a certain level, a dry pipe valve automatically opens so that water can be introduced into the piping. However, because gas is a compressible medium, it may take a relatively substantial amount of time for the pressure of the gas in the piping to decay to a level which is sufficient to open the dry pipe valve.

When a fire occurs, it is critical that water be quickly delivered to an operated sprinkler. For example, National Fire Protection Association Standard N.F.P.A. Pamphlet 13 requires that dry pipe sprinkler systems be constructed such that when the sprinkler head furthest from the dry pipe valve is operated, water will be delivered thereto within sixty seconds of the time of operation. For this reason, a dry pipe sprinkler system may require an accelerator which is utilized for sensing a slight but significant rate of decay in the dry pipe system gas pressure and for quickening the opening of the dry pipe valve connected thereto, in response to the pressure decay.

A differential type of a dry pipe valve may be constructed with two chambers: a main chamber that is exposed to system pressure and an intermediate chamber that is normally exposed to atmospheric pressure. Further, a differential type of dry pipe valve can be designed such that when a fluid under a pressure of essentially the same value as the gas in the system is admitted to the intermediate chamber, the channel between the source of water supply and the system will be opened. An accelerator may be interconnected by piping between its inlet and the pressurized portion of the system and between its outlet and the intermediate chamber of the dry pipe valve such that when the accelerator is actuated, gas under pressure is admitted from the system to the intermediate chamber of the dry pipe valve to effect the opening of the latter. Once water has been introduced into a dry pipe sprinkler system by opening of its dry pipe valve, the water can freely pass through the piping system leading to the sprinkler heads.

A type of dry pipe sprinkler system is a preaction system. Preaction sprinkler systems may be used in locations where accidental water discharge could result in significant property damage due to the presence of water-sensitive materials or equipment. Preaction systems are hybrid systems of wet and dry systems, and can include single interlock and double interlock features.

Operation of the single interlock system is similar to dry systems except that these systems require that a preceding fire detection event, typically the activation of a heat or smoke detector, takes place prior to the action of water introduction into the system's piping by opening the preaction valve, which can be an automatic, mechanically actuated valve. Opening the valve converts essentially a dry system into a wet system. The intent is to reduce the undesirable time delay of water delivery to sprinklers that is inherent in dry systems. Prior to fire detection, if the sprinkler operates or the piping system develops a leak, loss of air pressure in the piping can activate a trouble alarm. In this case, the preaction valve does not open due to loss of supervisory pressure, and water will not enter the piping.

Double interlock systems employ automatic sprinklers. These systems detect a preceding event, typically the activation of a heat or smoke detector, and also include operation of an automatic sprinkler prior to the action of water being introduced into the piping system. Activation of just the fire detectors alone or just the sprinklers alone, without the concurrent operation of the other, does not allow water to enter the piping system. Double interlock systems are considered essentially dry systems in terms of water delivery times.

The controlled discharge gas vent can provide a means for maintaining control of the pressure within the fire sprinkler system piping network while at the same time providing for the controlled discharge of a measured amount of gas that is contained in the fire sprinkler system piping network. The vent allows the fire sprinkler system piping system to "breathe," where for example a gas having lower relative humidity, such as dehumidified air or dry nitrogen gas, is admitted to the piping network during a pressuring-up phase and a mixture of gases (e.g., containing the dehumidified air or nitrogen) and a portion the original gas that was contained in the piping system is vented during a pressuring-down phase. The pressure within the fire sprinkler system piping network is therefore maintained in a controllable range of pressures throughout the breathing process called the "breathing range."

The controlled discharge gas vent can be used to reduce corrosion in the fire protection system. Oxygen present in air and water vapor present within the fire protection system can be vented from the system and effectively displaced by using the controlled discharge gas vent in conjunction with one or more breathing cycles to purge the system from substantially all oxygen or to reduce the amount of water vapor contained in the gas within the piping system. For example, oxygen and/or water vapor may be displaced with dry nitrogen provided by a nitrogen generator. Removal of oxygen and/or water vapor reduces or eliminates the effects of oxidative corrosion of ferrous and cuprous components of the fire protection system and can further deprive aerobic microbiological organisms the opportunity to grow within the system. Curtailing the growth of aerobic microbiological organisms serves to limit another source of corrosion and can limit solids and debris within the system.

Oxygen and/or water vapor within the fire protection system may be present in pressurized air used to maintain the dry pipe valve shut until the system is actuated. For example, initial pressurization of the dry pipe system can be done using an air compressor to rapidly fill the dry piping network above the trip pressure. Testing or actuation of the system also introduces water, including dissolved oxygen, into the piping network, resulting in residual liquid water that pools in low spots of the piping network and/or resulting from condensation of water vapor within the piping network. Use of the controlled discharge gas vent and breathing cycle(s) can significantly reduce or eliminate corrosion in the dry pipe system. For example, as oxygen is often the primary corrosive specie within the system, displacement of a large percentage of the oxygen with noncorrosive nitrogen by using the controlled discharge gas vent and breathing cycle can preserve the integrity and hydraulics of the fire protection system.

An embodiment of the breathing process employing the controlled discharge gas vent is illustrated by the following steps.

Step 1: The fire sprinkler system piping network sits empty at atmospheric pressure, i.e., about 14.7 psi, filled with air which contains approximately 78% nitrogen gas and 21% oxygen gas.

Step 2: The fire sprinkler system piping network is pressurized with compressed air to attain at least a sufficient pressure within the piping system to prevent the dry pipe valve from opening, which would allow water from the upstream side of the dry pipe valve to enter the fire sprinkler system piping network. The pressure at which the dry pipe valve would actuate and open is called the "trip pressure." For example, the trip pressure for the valve may be about 25 psig. Therefore, as long as the pressure in the fire sprinkler system piping network is maintained above 25 psig, then the dry pipe valve will not actuate and water will not enter the fire sprinkler system piping network.

Step 3: The fire sprinkler system piping network is pressurized with additional compressed air to achieve a pressure of about 40 psig, for example. This pressure is the "high limit" pressure of the breathing range. At this pressure the introduction of additional compressed air is stopped.

Step 4: One or more controlled discharge gas vents within the fire sprinkler system piping network are opened to allow gas to escape from the system. As a result, the pressure drops incrementally from 40 psig. The gas continues to vent from the fire sprinkler system piping network at a rate that is controlled by the vent(s) while preventing the sudden depressurization of the system. This controlled release of gas and the resultant drop in fire sprinkler system piping network pressure continues until the system pressure drops to about 30 psig, for example. This pressure is the "low limit" pressure of the breathing range, which is above the trip pressure. At this point, the nitrogen generator pneumatic pressure switch senses the low limit pressure and opens a control valve in the nitrogen generator to begin repressurizing the fire sprinkler system piping network with compressed gas having reduced humidity relative to the compressed gas within the piping network; e.g., dry nitrogen gas of purity greater than or about 90%. As illustrated, the breathing range in the present example is from 30 psig up to 40 psig. All of the breathing takes place at a pressure that exceeds the minimum trip pressure of the dry pipe valve, which is 25 psig in the present example.

Step 5: Pressurized gas having reduced humidity, such as nitrogen produced from a nitrogen generator, or some acceptable nitrogen gas storage vessel, is pumped into the fire sprinkler system piping network until the pressure in the system reaches the high limit pressure of the breathing range. At this point, the nitrogen generator pneumatic pressure switch senses the high limit pressure and closes a control valve in the nitrogen generator to stop pressurizing the fire sprinkler system piping network with the compressed nitrogen gas. This completes one breathing cycle.

Step 6: During the pressurizing and depressurizing process (i.e., breathing), one or more of the controlled discharge gas vents may remain open to allow for the continuous discharge of a controlled amount of mixed gases (e.g., air and enriched nitrogen) from the fire sprinkler system piping network.

Step 7: With every breathing cycle, the gas composition within the fire sprinkler system piping changes as water vapor within the piping network is displaced with gas having a lower relative humidity. For example, purified nitrogen gas (of at least about 90% purity, for example) can be added to the fire sprinkler system piping network during the pressurizing phase of the breathing cycle and the mixed gas (residual pressurized air plus the added nitrogen) discharged from the system during the depressurizing phase of the breathing cycle. Over a period of time, the gas composition within the fire sprinkler system piping network gets closer and closer to the composition of the introduced gas having lower relative humidity; e.g., purified nitrogen gas added from the nitrogen generator.

The rate of gas discharge and the changeover in the composition of the gas within the fire sprinkler system piping network from 100% air to about 90% nitrogen (or higher), for example, is controlled by the breathing range pressures, the number and location of vents installed on the fire sprinkler system piping network, and the size of the orifices that are installed in the vents. It is possible to accurately determine the number of cycles and the time required to achieve a purity of about 90% nitrogen (or higher) throughout the fire sprinkler system piping network. See the vent breathing rate calculation examples presented in Table 1.

TABLE 1

Vent Breathing Rate Calculator

| Parameter | Value | Units | Operation |
|---|---|---|---|
| Sprinkler system capacity (gallons) | 800 | gallons | |
| Sprinkler system capacity (ft 3) | 106.9 | ft 3 | Converts gallons to standard cubic foot (SCF) |
| Equivalent SCF @ (psig) 25 | 288.8 | scf | Converts volume to volume at high end breathing pressure |
| Equivalent SCF @ (psig) 18 | 237.9 | scf | Converts volume to volume at low end breathing pressure |
| Difference (to be vented per cycle) | 50.93 | scf | Amount of gas vented between low end and high end |
| Vent rate from one #10 orifices | 2.92 | scfh | Venting rate of gas from #10 orifice at 20 psig |
| Vent rate from one #8 orifices | 1.80 | scfh | Venting rate of gas from #8 orifice at 20 psig |
| Vent rate from one #5 orifices | 0.70 | scfh | Venting rate of gas from #5 orifice at 20 psig |
| Total venting rate | 5.42 | scfh | Total venting rate |
| Time for venting step | 9.40 | hrs | Total amount of time (hrs) to vent the 50.93 scf from the system |
| Time for venting step | 563.8 | mins | Total amount of time (min) to vent the 50.93 scf from the system |
| Estimated Membrane N2 4% production rate at 75 deg F. and 85 psig | 155 | scfh | Total amount of nitrogen delivered per hour from generator |

TABLE 1-continued

| Vent Breathing Rate Calculator | | | |
|---|---|---|---|
| Parameter | Value | Units | Operation |
| Net filling rate at 75 deg F. and 96% | 149.6 | scfh | Total amount of nitrogen delivered per hour less bled during filling |
| Time for fill step | 0.34 | hr | Length of rime required to fill the vent gas back up in the system |
| Total system venting cycle time | 9.74 | hr | Total cycle of venting and filling |

TABLE 2

| Orifice-Pressure Measurements for Calculations in Table 1 | | | | | | |
|---|---|---|---|---|---|---|
| PRESS | Orifice #4 | Orifice #5 | Orifice #8 | Orifice #10 | Orifice #12 | Orifice #19 |
| 10 psig | 0.25 | 0.47 | 1.21 | 1.97 | 2.73 | 6.00 |
| 20 psig | 0.40 | 0.70 | 1.80 | 2.92 | 4.07 | 9.03 |
| 25 psig | 0.47 | 0.82 | 2.08 | 3.37 | 4.66 | 10.40 |

The controlled discharge gas vent may include additional features. For example, in order to control the rate of gas discharge from the pipe through the orifice, it is necessary to prevent plugging of the metal orifice. Pipelines routinely contain debris, corrosion byproduct, mineral scale, and other solid or semi-solid material that might block gas flow through the discharge orifice. Therefore, an in-line filter may be used to protect the orifice from possible blockage by debris.

In order to prevent discharge of water through the vent from the fire sprinkler system piping network during a fire response, a liquid sensing valve may be included. For example, a liquid sensing valve can include a levered float valve or an electric liquid sensing control unit. While gas is flowing through the fire sprinkler system piping network, the orifice in the float valve allows for gas to flow freely. In the event of a fire response, water will fill the fire sprinkler system piping network. When water reaches the liquid sensing valve, such as a float valve, an internal float rises on the incoming water to actuate a levered plug which seats on an elastomeric seal at the orifice. This action stops the flow of gas and water from the pipeline through the controlled discharge gas vent.

In order to prevent plugging of the float valve orifice, an in-line "Y"-strainer may be installed upstream of the float valve to capture any debris, corrosion by-product, mineral scale, or any other solid or semi-solid material that might block the gas or water flow through the float valve orifice.

Two other components may be included in the controlled discharge gas vent to provide for ease of installation and servicing of the vent. The first is an isolation ball valve and the second is a union.

An embodiment of the controlled discharge gas vent 100 constructed according to the present disclosure is shown in FIG. 1. The various vent components and their specific functions are illustrated as follows. A ball valve 110 provides isolation of the controlled discharge gas vent 100 from the fire sprinkler system piping (not shown), which is pressurized and provides the gas flow 105. A coupling union 115 provides easy installation or change out of the vent 100. A Y-strainer type filter 120 protects a metallic orifice 145 at the discharge of a levered float valve 125 from plugging with pipe debris. The levered float valve 125 or equivalent electric liquid sensing control unit allows gas discharge from the piping system but not liquid discharge; water can be prevented from flowing out of the vent 100 location if the float activates when liquid enters the valve 125 by sealing the discharge orifice. A gas sampling port 130 allows for gas analysis using a manual or automatic gas sampling device. An in-line filter 135 protects the end-of-line metallic orifice 145 from plugging with debris. An adjustable back pressure regulator 140 with a gauge prevents complete depressurization of the fire sprinkler system piping by automatically closing the vent 100 if the system pressure falls below a preset minimum pressure on the regulator 140. The preset minimum pressure can be set at a pressure above the trip pressure of the dry pipe valve by setting a minimum closing pressure that is above the trip pressure of the dry pipe valve. The end of line metallic orifice 145 provides for the controlled release of gas from the pressurized piping system. And an end of line muffler 150 may be used to deaden the sound of the gas exhaust 155.

Discharge rate of gas, e.g., in standard cubic feet per hour (SCFH), from the vent can be controlled using orifices having particular diameters. For example, such orifices can employ a one-piece construction of solid metal; e.g., brass or stainless steel. Suitable orifices are available from O'Keefe Controls Co., Trumbull, Conn. Accurate machining allows predictable discharge rates based on the orifice diameter. Typical sizes range from 0.004" to 0.125" in orifice diameter, which are given a number (#) designation, for example. Table 3 lists some typical orifice sizes and Table 4 lists air flow in SCFH; these orifice sizes and flow rates are illustrative only as larger or smaller orifices may be employed depending on the particular needs and design of the vent and system.

TABLE 3

| Orifice Sizes | |
|---|---|
| Size Number | Orifice Diameter (inch) |
| 4 | .0039 |
| 5 | .0051 |
| 6 | .0059 |
| 7 | .0071 |
| 8 | .0079 |
| 9 | .0091 |
| 10 | .0102 |
| 11 | .0110 |
| 12 | .0122 |
| 13 | .0130 |
| 14 | .0142 |
| 15 | .0150 |
| 16 | .016 |
| 17 | .017 |
| 18 | .018 |
| 19 | .019 |
| 20 | .020 |
| 21 | .021 |
| 22 | .022 |
| 23 | .023 |
| 24 | .024 |
| 25 | .025 |

TABLE 4

Metal Orifice Air Flow - SCFH

| | | Orifice Diameter Inches | | | | | | | | | | |
|---|---|---|---|---|---|---|---|---|---|---|---|---|
| | | 0.004 | 0.005 | 0.006 | 0.007 | 0.008 | 0.009 | 0.010 | 0.011 | 0.012 | 0.013 | 0.014 |
| Size Number | | 4 | 5 | 6 | 7 | 8 | 9 | 10 | 11 | 12 | 13 | 14 |
| $C_v$ | | 0.00035 | 0.00061 | 0.00086 | 0.0012 | 0.0015 | 0.0019 | 0.0025 | 0.0028 | 0.0034 | 0.0038 | 0.0043 |
| Supply | 1 | 0.075 | 0.136 | 0.182 | 0.269 | 0.360 | 0.479 | 0.593 | 0.653 | 0.843 | 0.962 | 1.11 |
| Pressure - | 5 | 0.18 | 0.33 | 0.45 | 0.64 | 0.85 | 1.10 | 1.37 | 1.15 | 1.94 | 2.25 | 2.56 |
| psig | 10 | 0.25 | 0.47 | 0.65 | 0.91 | 1.21 | 1.57 | 1.97 | 2.14 | 2.73 | 3.14 | 3.56 |
| | 15 | 0.34 | 0.59 | 0.82 | 1.14 | 1.53 | 1.97 | 2.48 | 2.67 | 3.43 | 3.92 | 4.45 |
| | 20 | 0.40 | 0.70 | 0.97 | 1.38 | 1.80 | 2.33 | 2.92 | 3.16 | 4.07 | 4.64 | 5.28 |
| | 25 | 0.47 | 0.82 | 1.12 | 1.59 | 2.08 | 2.69 | 3.37 | 3.62 | 4.66 | 5.30 | 6.06 |
| | 30 | 0.53 | 0.92 | 1.26 | 1.80 | 2.37 | 3.03 | 3.81 | 4.09 | 5.23 | 5.98 | 6.80 |
| | 40 | 0.64 | 1.15 | 1.56 | 2.22 | 2.92 | 3.75 | 4.68 | 5.02 | 6.44 | 7.31 | 8.33 |
| | 50 | 0.76 | 1.37 | 1.86 | 2.67 | 3.50 | 4.45 | 5.55 | 5.93 | 7.59 | 8.62 | 9.83 |
| | 60 | 0.89 | 1.59 | 2.16 | 3.09 | 4.05 | 5.13 | 6.40 | 6.84 | 8.75 | 10.0 | 11.3 |
| | 70 | 1.02 | 1.82 | 2.46 | 3.54 | 4.60 | 5.83 | 7.27 | 7.76 | 9.92 | 11.3 | 12.8 |
| | 80 | 1.14 | 2.04 | 2.75 | 3.96 | 5.15 | 6.53 | 8.12 | 8.67 | 11.1 | 12.6 | 14.3 |
| | 90 | 1.27 | 2.27 | 3.05 | 4.41 | 5.70 | 7.20 | 8.96 | 9.56 | 12.2 | 13.9 | 15.9 |
| | 100 | 1.40 | 2.48 | 3.35 | 4.83 | 6.25 | 7.88 | 9.81 | 10.5 | 13.4 | 15.3 | 17.4 |
| Vacuum | 5 | 0.113 | 0.203 | 0.273 | 0.405 | 0.536 | 0.703 | 0.860 | 0.953 | 1.23 | 1.40 | 1.64 |
| Level | 10 | 0.145 | 0.263 | 0.356 | 0.521 | 0.687 | 0.892 | 1.10 | 1.20 | 1.55 | 1.77 | 2.06 |
| In. Hg. Chocked | 15 | 0.158 | 0.284 | 0.392 | 0.568 | 0.744 | 0.964 | 1.20 | 1.30 | 1.68 | 1.91 | 2.26 |
| Flow | 20 | 0.158 | 0.284 | 0.392 | 0.568 | 0.744 | 0.964 | 1.20 | 1.30 | 1.68 | 1.91 | 2.26 |
| | 30 | 0.158 | 0.284 | 0.392 | 0.568 | 0.744 | 0.964 | 1.20 | 1.30 | 1.68 | 1.91 | 2.26 |

| | | Orifice Diameter Inches | | | | | | | | | | |
|---|---|---|---|---|---|---|---|---|---|---|---|---|
| | | 0.015 | 0.016 | 0.017 | 0.018 | 0.019 | 0.020 | 0.021 | 0.022 | 0.023 | 0.024 | 0.025 |
| Size Number | | 15 | 16 | 17 | 18 | 19 | 20 | 21 | 22 | 23 | 24 | 26 |
| $C_v$ | | 0.0050 | 0.0055 | 0.0067 | 00.73 | 0.0080 | 0.0088 | 0.0096 | 0.011 | 0.012 | 0.13 | 0.014 |
| Supply | 1 | 1.30 | 1.40 | 1.64 | 1.82 | 2.03 | 2.22 | 2.39 | 2.73 | 2.99 | 3.26 | 3.54 |
| Pressure - | 5 | 2.99 | 3.26 | 3.73 | 4.20 | 4.70 | 5.23 | 5.62 | 6.29 | 6.87 | 7.48 | 8.12 |
| psig | 10 | 4.13 | 4.26 | 4.79 | 5.38 | 6.00 | 6.70 | 7.48 | 9.17 | 10.1 | 11.0 | 11.8 |
| | 15 | 5.17 | 5.30 | 6.04 | 6.84 | 7.56 | 8.50 | 9.34 | 11.3 | 12.6 | 13.6 | 14.7 |
| | 20 | 6.08 | 6.29 | 7.20 | 8.18 | 9.03 | 10.3 | 11.1 | 13.5 | 14.7 | 16.1 | 17.3 |
| | 25 | 6.95 | 7.25 | 8.31 | 9.43 | 10.4 | 11.8 | 12.7 | 15.5 | 16.8 | 18.3 | 19.9 |
| | 30 | 7.82 | 8.20 | 9.39 | 10.7 | 11.8 | 13.4 | 14.4 | 17.4 | 19.0 | 20.7 | 22.5 |
| | 40 | 9.56 | 10.1 | 11.6 | 13.2 | 14.5 | 16.5 | 17.8 | 21.4 | 23.3 | 25.4 | 27.5 |
| | 50 | 11.3 | 12.1 | 13.8 | 15.7 | 17.3 | 19.6 | 21.2 | 25.2 | 27.5 | 30.1 | 32.6 |
| | 60 | 13.0 | 14.0 | 16.0 | 18.2 | 20.0 | 22.7 | 24.6 | 29.2 | 31.8 | 34.7 | 37.5 |
| | 70 | 14.7 | 16.0 | 18.2 | 20.7 | 22.9 | 25.9 | 28.0 | 33.1 | 36.0 | 39.2 | 42.6 |
| | 80 | 16.5 | 17.9 | 20.5 | 23.3 | 25.6 | 29.0 | 31.6 | 37.1 | 40.3 | 43.9 | 47.7 |
| | 90 | 18.3 | 19.9 | 22.7 | 25.9 | 28.4 | 32.2 | 35.0 | 40.9 | 44.5 | 48.5 | 52.8 |
| | 100 | 20.0 | 21.8 | 25.0 | 28.4 | 31.1 | 35.2 | 38.1 | 44.7 | 48.7 | 53.2 | 58.1 |
| Vacuum | 5 | 1.90 | 2.07 | 2.41 | 2.70 | 2.99 | 3.28 | 3.60 | 4.03 | 4.45 | 4.87 | 5.25 |
| Level | 10 | 2.37 | 2.62 | 2.99 | 3.35 | 3.79 | 4.15 | 4.62 | 5.17 | 5.68 | 6.12 | 6.63 |
| In. Hg. Chocked | 15 | 2.59 | 2.86 | 3.28 | 3.71 | 4.11 | 4.64 | 4.92 | 5.53 | 6.04 | 6.61 | 7.08 |
| Flow | 20 | 2.59 | 2.86 | 3.28 | 3.71 | 4.11 | 4.64 | 4.92 | 5.53 | 6.04 | 6.61 | 7.08 |
| | 30 | 2.59 | 2.86 | 3.28 | 3.71 | 4.11 | 4.64 | 4.92 | 5.53 | 6.04 | 6.61 | 7.08 |

The discharge gas from the controlled discharge gas vent can be coupled to a sensor or analyzer. For example, in order to further control corrosion, oxygen gas that is contained in the fire sprinkler system piping network, for example as part of pressurized air, can be displaced with dehumidified air or nitrogen gas from a nitrogen generator. Likewise, water vapor contained in the pressurized piping network can be displaced by dehumidified air or dry nitrogen from the nitrogen generator, for example. Determining the composition of the gas contained within the fire sprinkler system piping network can provide evidence that the displacement process is progressing. For example, it is not readily feasible to measure the level of nitrogen in gas as the inert nature of the nitrogen gas molecule means it does not readily react with other elements. Accordingly, the level of nitrogen in the pipeline can be derived indirectly by measuring the level of oxygen in the pipeline.

The oxygen sensor may be used to measure effective displacement of oxygen during the initial setup or installation of the system, following actuation or testing of the system, and/or for monitoring the system while in service. For example, in a dry pipe sprinkler system, one or more oxygen sensors may be connected to the piping network to ascertain whether pressurized nitrogen supplied by the nitrogen generator has effectively displaced oxygen in the system to below a predetermined threshold or to a level where oxygen is no longer detectable. The oxygen sensor may also be used in an automated system to trigger the nitrogen generator to purge or flush the system or the system may be manually activated based on a reading provided by the oxygen sensor. For example, the oxygen sensor may be coupled to an alarm indicating that oxygen is present or at an undesirable level within the fire protection system. In the case where the system is automated, the oxygen sensor may also be coupled to a pressure monitor and may trigger the breathing process to sustain pressure above the low limit pressure (e.g., above the trip pressure) by supplying additional nitrogen gas and/or trigger the breathing process to purge any buildup of oxygen while maintaining the pressurized system between the low limit pressure and the high limit pressure.

As described, the volume of the gas being discharged from the fire sprinkler system piping network from one of the controlled discharge gas air vents can be split into a "high flow" stream and a "low flow" stream, where the "low flow" stream can be used to take the oxygen measurement. For example, the "low flow" stream may provide a continuous flow for the oxygen measurement. A mechanical valve such as an electric solenoid valve can be placed on the "high flow" stream and any other vents on the system. When the oxygen sensor achieves the desired oxygen concentration for the desired time period, a signal can be sent to the electric solenoid valve(s) to close off the "high flow" stream and any other vents on the system. This can allow for lower energy consumption and lower maintenance costs to support the lower oxygen levels within the system.

Oxygen analyzers are commercially available that can accurately determine the weight percent of oxygen in a gas sample. Oxygen analyzers are available as hand held manual analyzers that capture samples at a point in time or as continuous analyzers that continuously monitor the discharge gas composition. Oxygen analyzers typically require a flowing stream of the gas that is being sampled in order to measure the level of oxygen in that gas. Suitable oxygen sensors include those provided by: GE Sensing—Panametrics (Billerica, Mass.), built in oxygen analyzers; Maxtec (Salt Lake City, Utah), handheld oxygen analyzers; and AMI (Huntington Beach, Calif.), built in oxygen analyzers.

Also, the water vapor contained in the pressurized piping network can be determined by detecting the humidity in the gas being vented from the vents. This allows for the continuous analyzing of the discharge gas when dehumidified air is being used to control corrosion within the piping system, for example. Humidity sensors include resistive, capacitive, and thermal conductivity sensing technologies. Suitable humidity sensors include those provided by: America Humirel, Inc. (Dearborn Heights, Mich.), Honeywell Sensing and Control (Golden Valley, Minn.), and Sensirion Inc. (Westlake Village, Calif.).

As described, the volume of gas that is being discharged from the fire sprinkler system piping network during the breathing process is controlled by one or more controlled discharge gas vents. The vent provides controlled discharge of a metered amount of gas from the fire sprinkler system piping network. Any sample stream of the fire sprinkler system piping network gas for analysis can be considered as part of the overall gas discharge equation, with respect to the breathing cycle and the calculations illustrated in Table 1, for example. All or a portion of the discharge gas stream being exhausted from the vent can be used to provide a sample stream for the continuous gas analyzer. For example, the oxygen sensor and/or humidity sensor can be coupled to a backpressure regulator that always allows a "low flow" stream to pass so that the sensor is provided with a continuous gas stream for measurement. Alternatively, the sensor may be coupled to the vent upstream of the backpres sure regulator using tubing and/or an orifice that provides a continuous "low flow" stream of gas to the sensor, while the backpressure regulator passes a "high flow" of gas when pressure is above a set threshold.

Table 5 illustrates features of an accurate and stable oxygen sensor useful to measure the oxygen content of pressurizing gas in dry and preaction fire sprinkler systems. The complete sensor can be built into an enclosure and fixed to a wall in the area of the fire sprinkler system piping network being monitored. The sensor also may be connected to the building management system and/or provide a visual read-out at the sensor unit.

TABLE 5

| Oxygen Sensor Features | |
|---|---|
| Sensor Type: | Zirconium Oxide |
| Expected Life: | 10 years |
| Drift: | Negligible |
| Measured range: | 0.1% to 25% oxygen by volume |
| Response time (90% of full scale): | 2 seconds |
| Accuracy/Reproducibility: | ±0.25%/0.1% |
| Temperature compensation: | Not required |
| Pressure compensation: | Not required |
| Sample connection: tubing | Quick connect for 5/32" |
| Sample flow: | Set and conditioned by the vent |
| Sample pressure: | Atmospheric |
| Input Voltage: | In the range +7 to +30 VDC, typically +24 VDC |
| Power Consumption: | up to 3 watts |
| Signal output: | 0 to 5 VDC, linear with measured range |
| Dimensions: | 9"(230 mm) wide, 11" (280 mm) tall, 4.5" (114 mm) deep |
| Weight: | 11 lb (5 kG) |
| Power & Signal Connection: | Through 7/8" diameter port (for 1/2" conduit connector) |

Figure 2:
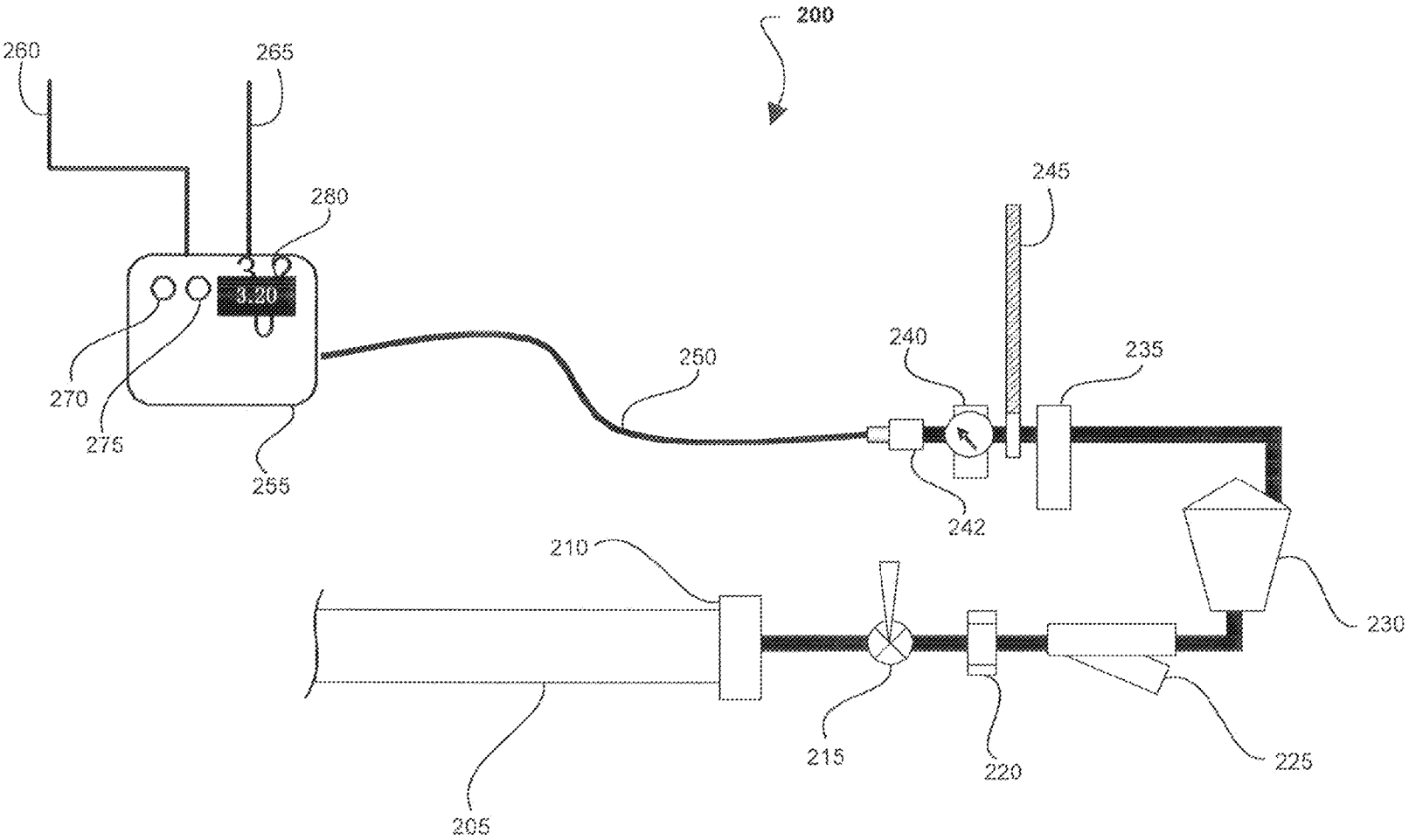
FIG. 2 illustrates an embodiment of a controlled discharge gas vent coupled to a fire protection system and coupled to an oxygen sensor and alarm constructed according to the present disclosure.

Shown in FIG. 2 is a portion of a fire protection system 200 that includes a controlled discharge gas vent and an oxygen sensor with an alarm. The fire protection system pipe 205, located for example at the end of a main line or branch line, has a reducer/coupler 210 to join the system piping to a line running to an isolation valve 215; e.g., a ball valve. A coupling union 220 is used to join the line from the isolation valve 215 to a Y-strainer 225 positioned ahead of a levered float valve 230. Running from the levered float valve 230 is an in-line filter 235 that is then coupled to an adjustable backpres sure regulator 240. One or more threaded hangers 245 are used to suspend the system 200 within the structure to be protected. Piping or high pressure tubing 250 runs from the metallic orifice 242 to an oxygen sensor 255. At least a portion of discharged gas from the regulator 240 is directed through the tubing 250. In some cases, a portion of gas is continuously vented from the regulator 240 through the tubing 250 to the oxygen sensor 255. The oxygen sensor 255 is connected to a power supply 260, e.g., 24V DC or 110V, and includes an output signal line 265 running to an alarm (not shown). The sensor 255 can be affixed to a wall, for example, and provides visual indicators, such as a power "on" lamp 270, alarm lamp 275, and a digital output 280 for $O_2$ level.

Other sensors may be used with the controlled discharge gas vent, in addition to or in lieu of the oxygen sensor. For example, the humidity of pressurized gas within the dry pipe pressurized piping network may be measured using a humidity sensor; e.g., electronic hygrometer. In this manner, the system may manually or automatically perform one or more breathing cycles, if necessary, to reduce the humidity of the pressurized gas below a predetermined threshold or below detectable limits.

Various gases may be used in breathing cycles with the dry pipe system and controlled discharge gas vent. Nitrogen is preferable as it can be used to simultaneously displace oxygen and dry the piping network by removing water. Nitrogen can also be provided using a nitrogen generator to enrich nitrogen from air. Likewise, carbon dioxide may be used to displace oxygen and/or water vapor. However, other gases, such as dehumidified air, may be used to dry the piping network. Or, in some cases, the breathing cycle may be run using just compressed air where the ambient air has a relatively low humidity and is capable of drying the piping network.

Various combinations of gases may also be employed. In some embodiments, the breathing cycles may initially use compressed air to substantially dry the piping network following hydrostatic testing, for example, and then the breathing cycles may shift to using pressurized nitrogen to displace oxygen and/or any residual water vapor. For the purpose of controlling or mitigating corrosion, any of a variety of dry gases, like dehydrated air, carbon dioxide, or argon, may be used as the purging gas.

In the case of the dry pipe system and controlled discharge gas vent, it is preferable to use nitrogen in the breathing cycles to fill the piping void space, pressurize the piping, and to mitigate the corrosion of the ferrous and cuprous metal components. Nitrogen, for example provided by a nitrogen generator, is used to pressurize the system, purge the initial quantities of oxygen and other gases trapped in the piping through one or more vents in the fire sprinkler system in order to dry the system, and to allow the quantity of nitrogen in the piping to increase and ultimately approach about 90% or greater following a number of breathing cycles. For example, the dew point of 95% nitrogen is approximately −71° F.; accordingly, the nitrogen will absorb moisture in the piping left from hydrostatic or other types of system testing or from condensation of saturated compressed air that had previously filled the pipe. The breathing process allows the nitrogen/air mixture to absorb water and carry it out of the system through the vent point(s), leaving the system in a significantly dryer state, while simultaneously displacing oxygen.

Dry pipe sprinkler systems including the controlled discharge gas vent can be advantageously employed in freezer or refrigerator applications or in environments where water may freeze. For example, under conditions where water may freeze, ice blocks can form in the sprinkler system piping network when compressed air containing water or saturated with water is used to pressurize the piping. As the moisture in the compressed air condenses in the piping, the water freezes to form ice that may restrict flow or even create an ice block or dam within the piping, preventing further gas or water flow altogether. Regenerative desiccant dryers or membrane dryers have been employed to prevent ice blocks from forming. However, flushing and purging with 90% or greater nitrogen, with its low dew point, eliminates the need for the regenerative desiccant or other types of air dryers. What is more, due to the difficulty of completely removing residual water from a complex sprinkler system, solely using dehumidified air for drying the pipe may not prevent or significantly reduce corrosion in remaining water filled areas or areas containing residual liquid water or water vapor which might later condense to form liquid water. If dry nitrogen is used as the drying medium, oxygen will also be removed along with the water and water vapor and corrosion will be substantially reduced or eliminated.

Several factors influence corrosion within a fire protection system. The nature of the materials used in construction of the system and their susceptibility to oxidation directly relate to the damage potential of oxygen and water. The source water provided to the system may include biological contaminants, dissolved and/or solid nonbiological contaminants, trapped air, and dissolved gases. A portion of the system can be in intermittent contact with liquid water, as is the case for a dry pipe or preaction system actuation during routine testing or servicing or when activated by a fire. In some cases, once started the corrosion process permits or accelerates further corrosion; for example, corrosion by-product (e.g., iron oxide) may be shed, sloughing off to expose new metal (e.g., iron) to oxidation. These factors and combinations of these factors can corrode the fire protection system, deteriorating its performance, or even result in system failure.

Fire protection systems are often constructed using ferrous and cuprous metallic pipes and fittings. Pipe materials typically come from the manufacturer or distributor with associated open-air corrosion on the internal and external walls. This can include but is not limited to: iron oxide mill scale caused during the manufacturing process by condensation of water on the metal surfaces and the subsequent generalized oxygen corrosion that results from oxygen attack, the metal loss is typically minimal with no significant pitting; debris from the storage yard on the threads and in the ends of the pipe; and the presence of other solids associated with outside storage, such as spider webs, dead bugs, etc. After or during the installation of the pipe, additional sources of debris and fouling may end up inside the assembled network of piping, including: residual cutting oil from the thread cutting process during installation, metal filings from the thread cutting process during installation, various forms of hydrocarbon based thread lubricants, and Teflon® tape used in assembly of the pipe fittings.

The source water used in the fire protection system is generally from a fresh potable water source with very low total dissolved solids (TDS). The water is generally saturated with oxygen from the atmosphere and contains very little, if any, insoluble suspended solids. It may also contain small (less than about 2 ppm) amounts of residual chlorine from municipal treatment at the source. The water may not contain any detectable levels of microorganisms, however, this does not preclude the presence of microorganisms, as they will simply be difficult to detect at the low levels that exist in the potable water.

Once installed, at least a portion of the fire protection system is filled and charged with water. In the case of a dry pipe system, the piping network is filled with water upon routine testing or following activation. As the source water fills the piping, all of the debris that is clinging to the interior walls will become mobilized. Materials that are insoluble in water (solids) will generally sink to settle and collect in all of the low spots within the system due to gravity. For example, in long runs of horizontal piping, the solids will collect at the six o'clock position, when viewing a pipe in cross-section. Any hydrocarbon within the system will float on the water and will tend to agglomerate (i.e., oil wet) any insoluble particulates that are contacted. It is also difficult to completely remove all of the air during the water charging process. Air (and water vapor) and liquid water that is left in the system creates a discrete air/water interface. As the system is pressurized, air will also dissolve into the water and quickly reach a state of equilibrium.

Oxygen corrosion may be the predominant form of corrosion and metal loss within the fire protection system. Air contains approximately 21% oxygen, and unless the source water is mechanically de-aerated or chemically treated to effect oxygen removal, it will generally contain about 8-10 ppm of dissolved oxygen when it first enters the piping. The oxygen will immediately react with any free iron it contacts on the pipe walls.

The initial fill of water will remove iron from the pipe walls and some small level of metal loss will occur. The metal loss will be most acute at the air/water interface where the dissolved oxygen content will be the highest. The soluble iron that is liberated from the pipe walls at the interface will almost immediately precipitate as iron oxide, probably as ferric oxide, commonly known as rust. The iron oxide may adhere to the pipe wall for a time, just below the air/water interface, but because of the loose, non-adhesive nature of the deposit, it is highly likely that the iron oxide will slough off and settle to the bottom of the pipe. Even slight turbulence or disturbances in the pipe network will cause the deposit to be shed, exposing new free iron for attack by oxygen. As the air-water-metal environment stagnates, the oxygen will be consumed and corrosion will slow down. If left undisturbed, the system could remain at a low general corrosion rate for a long period of time.

Several factors may accelerate or continue corrosion of the system, however. These include: addition of more oxygen, solids (e.g., iron oxides, particulate matter, etc.), growth of microbiological organisms, mechanical deposit removal, and draining and refilling the system, including testing or actuating the system. Any oxygen that enters the system will affect the equilibrium that exists between iron, water, and oxygen. More oxygen will cause additional free iron loss and create more solids by precipitating iron oxides. The metal loss at the air/water interface will once again become the site producing the most reaction and subsequent corrosion.

Solids accelerate corrosion by several mechanisms. Under-deposit acceleration may occur wherein the area under the solid achieves an anodic-character versus the adjacent metal. This anodic-character will mean that corrosion will be more aggressive under the deposit and pitting will occur. In oxygenated systems, the area under the deposit can become oxygen-depleted and can achieve anodic-character versus the adjacent metal. Once again, the corrosion under the deposit will become more aggressive and pitting will occur. Solids also provide an ideal environment for microbiological organisms, such as bacteria, to colonize. In addition, depending on the chemical make-up, the solids may serve as nutrient sources for the bacteria. Slimes and deposits that the bacteria create will also act as deposits under which pitting may occur.

There are a myriad of different mechanisms that come under the heading of microbiologically influenced corrosion (MIC). Generally, MIC refers to corrosion that is effected by the metabolic processes of mixed cultures of microorganisms, typically bacteria and fungi. For example, microorganisms can act to influence corrosion in three different ways. First, microorganisms can produce slimes and deposits that accelerate the under-deposit corrosion mechanisms; e.g., oxygen concentration cells in aerobic environments. Second, microorganisms produce metabolic by-products that directly contribute to the corrosion reaction; e.g., organic acid producers that solubilize the iron in mild steel. Third, microorganisms produce metabolic by-products that indirectly contribute to the corrosion reaction by acting as a cathodic depolarizer; e.g., sulfides produced by sulfate-reducing bacteria.

Depending on the type of bacteria that are involved the corrosion rate in the system can be accelerated by the following mechanisms: (1) slime formation—under-deposit pitting corrosion; (2) acid production—acidic pitting corrosion; and (3) sulfide anion production—cathodic depolarization resulting in pitting corrosion.

Mechanical deposit removal can allow additional corrosion. Anytime a corrosion deposit is removed from the metal surface, it creates a new site for attack. This will most often occur at the air/water interface and repeated removal of the deposit will create crevices.

Draining and refilling the system also allows additional corrosion. Each time the system is drained of the fluids and refilled, the high rate of oxygen corrosion that exists with a fresh supply of air will remove a new layer of iron from the pipe walls. Any deposits that exist on the metal surfaces will become oxygen concentration cells in the new oxygen rich fluids and the otherwise low general rate of corrosion will be greatly accelerated and pitting will occur.

In some embodiments, the fire protection system and controlled discharge gas vent can utilize a nitrogen generator to introduce nitrogen into the system to displace any oxygen via the described breathing cycle(s). The nitrogen generator can provide nitrogen on-demand to fill and/or purge a system as desired, automatically based on a sensor, such as an oxygen sensor, on a periodic basis, or on a continuous basis. Nitrogen generators and features relating to nitrogen generators include those as described in International Application No. PCT/US09/56000, Burkhart et al., filed Sep. 4, 2009.

In the case of a dry pipe sprinkler system, the nitrogen generator may be used to purge or recharge the pressurized piping network with nitrogen. For example, pressurized nitrogen within the piping network holds the dry pipe valve in the closed position to prevent entry of the pressurized water into the piping network. Any leaks in the sprinkler system may cause a loss of pressure. The nitrogen generator may therefore be used to recharge the pressurized piping network as needed and may be configured to do so automatically. For example, the fire protection system may include a pressure gauge to measure the nitrogen pressure against the dry pipe valve. The nitrogen generator may automatically provide pressurized nitrogen when the pressure gauge drops below a predetermined threshold. In this way, the nitrogen generator can automatically maintain the pressure above the low limit, which is above the trip pressure of the dry pipe valve, by supplying additional pressurized nitrogen as needed.

The fire protection system and controlled discharge vent may also be configured to continuously supply pressurized nitrogen into the piping network using the nitrogen generator, where the breathing cycles allow the pressure to slowly ramp between the low and high limits. In this case, the nitrogen generator provides a steady stream of pressurized nitrogen into the piping network to keep the dry pipe valve closed. To allow for continuously supplied pressurized nitrogen gas to enter the system, the controlled discharge gas vent opens. Pressurized nitrogen is vented while maintaining enough pressure within the system to prevent the dry pipe valve from opening. In the event the fire protection system is actuated, due to a fire or for testing, the pressure within the piping network is lost faster than the nitrogen generator can replace it, even when continuously applying pressurized nitrogen, thereby allowing the dry pipe valve to open and pressurized water to enter the piping network.

Continuous venting of the fire protection system using one or more controlled discharge gas vents facilitates removal of any oxygen within the system while maintaining the required system pressure (of nitrogen) for the fire sprinkler system. In dry or preaction fire sprinkler systems, 90%+ nitrogen gas (dew point of −70° F.) may also be used to dehydrate the system by pulling any water within the system into the dry nitrogen and venting the gas, thereby eliminating residual water, one of the key components in the corrosion reaction.

The present systems and methods can be used in conjunction with other components and methods in order to further reduce corrosion or treat corrosion and the effects of corrosion. For example, fire protection systems can be sterilized to control bacteria using chemical treatments and/or heated gases or liquids. Solids may be eliminated by cleaning and flushing the system. Corrosion can also be reduced in fire protection systems through the application appropriate corrosion inhibiting chemicals that are applied to the water that enters the fire protection system piping.

Corrosion inhibitors are commercially available that can significantly reduce the rate of oxygen corrosion in ferrous and cuprous metals. The corrosion inhibitors are generally proprietary formulations that retard the cathodic half reaction of the corrosion cell. There are also proprietary formulations that can be used to provide biocidal activity wherein the microbes within the fire sprinkler system piping are killed by exposure to toxic levels of the biocidal formulations. These products indirectly reduce the level of corrosion by preventing the proliferation of microorganisms and thereby preventing their corrosion accelerating activities including cathodic depolarization, under-deposit acceleration or organic acid attack of the ferrous or cuprous metallic components. In every instance, the use of nitrogen augments the reduction in corrosion that can be afforded through the use of corrosion inhibiting chemicals or microbiocidal chemicals.

The fire protection system and controlled discharge gas vent provide several benefits and advantages. For example, breathing cycles employing displacement of oxygen with nitrogen reduce or eliminate the primary corrosive specie within the aqueous environment that exists in a fire sprinkler system. Nitrogen can be applied whenever the system is tested or recharged or following actuation in the event of a fire. For example, each time the fire protection system is breached for annual testing or system modification, nitrogen is added to displace oxygen to prevent corrosion.

Nitrogen is preferred for use in the breathing cycle as it has many beneficial characteristics for use within a fire protection system. It is inert and will not participate, augment, support, or reinforce corrosion reactions. It can be used as a stripping gas to remove oxygen from the water and/or from the void space above the water with adequate venting. If venting is continued, the concentration of oxygen in the water and in the void space can be reduced to near zero. Nitrogen is non-toxic, odorless, colorless, and very "green," as it is not a greenhouse gas and may be generated on site and on-demand from air using a nitrogen generator. Where the fire protection system is coupled to a municipal water supply, with nitrogen there is no concern about toxicity or contamination of the water supply should any backflow occur from the fire protection system to the municipal water, as might be the case with other chemical additives. What is more, any water treated with nitrogen that must be discharged into the municipal sewer system is non-toxic and will contain little or no iron oxide resulting from corrosion of the piping. The present systems and methods using nitrogen also reduce or eliminate oxidation and degradation of elastomeric seats found in valves and other components of the fire protection system.

Nitrogen displacement of oxygen can also serve to inhibit growth of aerobic microbiological organisms within the fire protection system and may even result in death of these organisms. Aerobic forms of microbial contaminants generally pose the greatest risk of creating slimes in fresh water systems. These slimes pose serious risks to fire sprinkler systems because they can impact the hydraulic design of the fire sprinkler system if they form in sufficient quantities as sessile (attached) populations. These slimes can also slough off of the pipe walls and lodge in sprinklers and valves.

The present systems and methods substantially reduce or even eliminate growth of these aerobic microbiological organisms and prevent subsequent slime formations.

The present systems and methods employ a nitrogen generator that provides several advantages. Nitrogen generators are a cost-effective means for continuous administration of nitrogen to the fire protection system. They obviate the need for gas cylinder inventory, changing out of gas cylinders, and risks associated with handling gas cylinders. Nitrogen generators only require a compressed air supply to separate atmospheric nitrogen from oxygen.

The present technology is further described in the following example. The example is illustrative and does not in any way limit the scope of the technology as described and claimed.

EXAMPLE 1

Breathing Dry Pipe System

An embodiment of a fire protection system comprises a dry pipe sprinkler system and one or more controlled discharge gas vents that are operable to breathe and displace oxygen and water vapor. The dry pipe sprinkler system utilizes water as an extinguishing agent. The system piping from the dry pipe valve to the fusible sprinklers is filled with pressurized nitrogen. In some cases, the system is an air check system or further includes an air check system. An air check system is a small dry system which is directly connected to a wet pipe system. The air check system uses a dry valve and a nitrogen generator but does not have a separate alarm. The alarm is provided by the main alarm valve.

A dry pipe system is primarily used to protect unheated structures or areas where the system is subject to freezing. Under such circumstances, it may be installed in any structure to automatically protect the structure contents and/or personnel from loss due to fire. The structure must be substantial enough to support the system piping when filled with water. The system should be designed by qualified design engineers in conjunction with recommendations from insuring bodies.

The dry pipe system may include several components. Although various dry pipe systems constructed according to the present teachings will function in the same manner, the components and arrangements may vary due to the application of different sets of standards. For example, the size and geometry of the fire protection system is based on the particular installation and coverage.

The water supply includes an adequate water supply taken from a city main, an elevated storage tank, a ground storage reservoir and fire pump, or a fire pump taking suction from a well and pressure tank.

Underground components include piping of cast iron, ductile iron or cement asbestos; control valves and/or post indicator valves (PIV); and a valve pit. The valve pit is usually required when multiple sprinkler systems are serviced from a common underground system taking supply from a city main: two OS & Y valves, check valves or detector check, fire department connection (hose connection and check valve with ball drip). Depending on local codes for equipment and building requirements, a backflow preventer, full-flow meter, or combinations of equipment may be required.

Auxiliary equipment includes fire hydrants with outlets for hose line and/or fire truck use.

Portions of the system inside the structure include the following. A check valve must be incorporated if not already provided in the underground system. A control valve, such as a wall PIV or OS&Y must be incorporated if a control valve is not already provided in the underground piping for each system. A dry pipe valve with the following features: the dry-pipe valve and pipe to the underground system must be protected from freezing, for example, the structure or enclosure should be provided with an automatic heat source, lighting, and sprinkler protection; a nitrogen generator (automatic or manual) capable of restoring nitrogen pressure to the system in 30 minutes or less; an accelerator is required when system capacity exceeds 500 gallons (1892.7 liters); a water motor alarm or electric pressure switch; and valve trim and pressure gauges.

Fire department connection to the system is provided by a hose connection and check valve with a ball drip, if it is not already provided as part of the underground components.

The system piping progressively increases in size in proportion to the number of sprinklers from the most remote sprinkler to the source of supply. The pipe size and distribution is determined from pipe schedules or hydraulic calculations as outlined by the appropriate standard for the hazard being protected.

Sprinklers include various nozzles, types, orifice sizes, and temperature ratings, as known in the art. Sprinklers installed in the pendent position must be of the dry pendant type when the piping and sprinkler are not in a heated area that may be subject to freezing temperatures. Sprinklers are spaced to cover a design-required floor area.

The system includes an inspector's test and drain components. A test drain valve must be provided. All piping is pitched toward a drain. A drain is provided at all low points. A two-valve drum drip may be required. An inspector's test is required on each system. The inspector's test simulates the flow of one sprinkler and is used when testing the system to ensure that the alarm will sound and the water will reach the farthest point of the system in less than one minute.

The system includes various pipe hangers as needed.

The point of incorporation for the nitrogen discharge from the nitrogen generator is typically at a point just above the dry pipe valve on the main riser. The point of entry into the piping is a pipe equipped with a check valve to prevent backflow to the nitrogen generator.

One or more controlled discharge gas vents with oxygen sensors are positioned in the piping network. The vents are positioned at or near the end of a length of pipe in the piping network. In this way, when the piping network is filled with pressurized nitrogen for service or when the piping network is purged with nitrogen for drying after testing or actuation, the vent and sensor are used to ensure that all or an appropriate level of oxygen is displaced as the nitrogen stream is allowed to exit a terminal vent within the piping network.

The fire protection system operates as follows. When a fire occurs, the heat produced will operate a sprinkler causing the nitrogen pressure in the piping system to escape. When the pressure trip-point is reached (directly or through the accelerator), the dry-pipe valve opens allowing water to flow through the system piping and to the water motor alarm or electric pressure switch to sound an electric alarm. The water will continue to flow and the alarm will continue to sound until the system is manually shut off. A dry-pipe valve equipped with an accelerator will trip more rapidly and at a higher air-pressure differential. Component parts of the dry-pipe system operate in the following manner.

The dry valve operates as follows. When the nitrogen pressure in the dry system has dropped (from the fusing of an automatic sprinkler) to the tripping point of the valve, the floating valve member assembly (air plate and water clapper) is raised by the water pressure trapped under the clapper. Water then flows into the intermediate chamber, destroying the valve differential. As the member assembly rises, the hook pawl engages the operating pin which unlatches the clapper. The clapper is spring-loaded and opens to the fully opened and locked position automatically.

The accelerator operates on the principal of unbalanced pressures. When the accelerator is pressurized, nitrogen enters the inlet, goes through the screen filter into the lower chamber and through the anti-flood assembly into the middle chamber. From the middle chamber the nitrogen slowly enters the upper chamber through an orifice restriction in the cover diaphragm. In the SET position the system nitrogen pressure is the same in all chambers. The accelerator outlet is at atmospheric pressure. When a sprinkler or release operates, the pressure in the middle and lower chambers will reduce at the same rate as the system. The orifice restriction in the cover diaphragm restricts the nitrogen flow from the upper chamber causing a relatively higher pressure in the upper chamber. The pressure differential forces the cover diaphragm down pushing the actuator rod down. This action vents the pressure from the lower chamber to the outlet allowing the inlet pressure to force the clapper diaphragm open. The pressure in the accelerator outlet forces the anti-flood assembly closed, preventing water from entering the middle and upper chambers.

On a dry pipe system, the nitrogen pressure from the accelerator outlet is directed to the dry pipe valve intermediate chamber. As the nitrogen pressure increases in the intermediate chamber, the dry valve pressure differential is destroyed and the dry valve trips allowing water to enter the dry pipe system. On a pneumatic release system, the outlet pressure is vented to atmosphere, speeding the release system operation.

Figure 3:
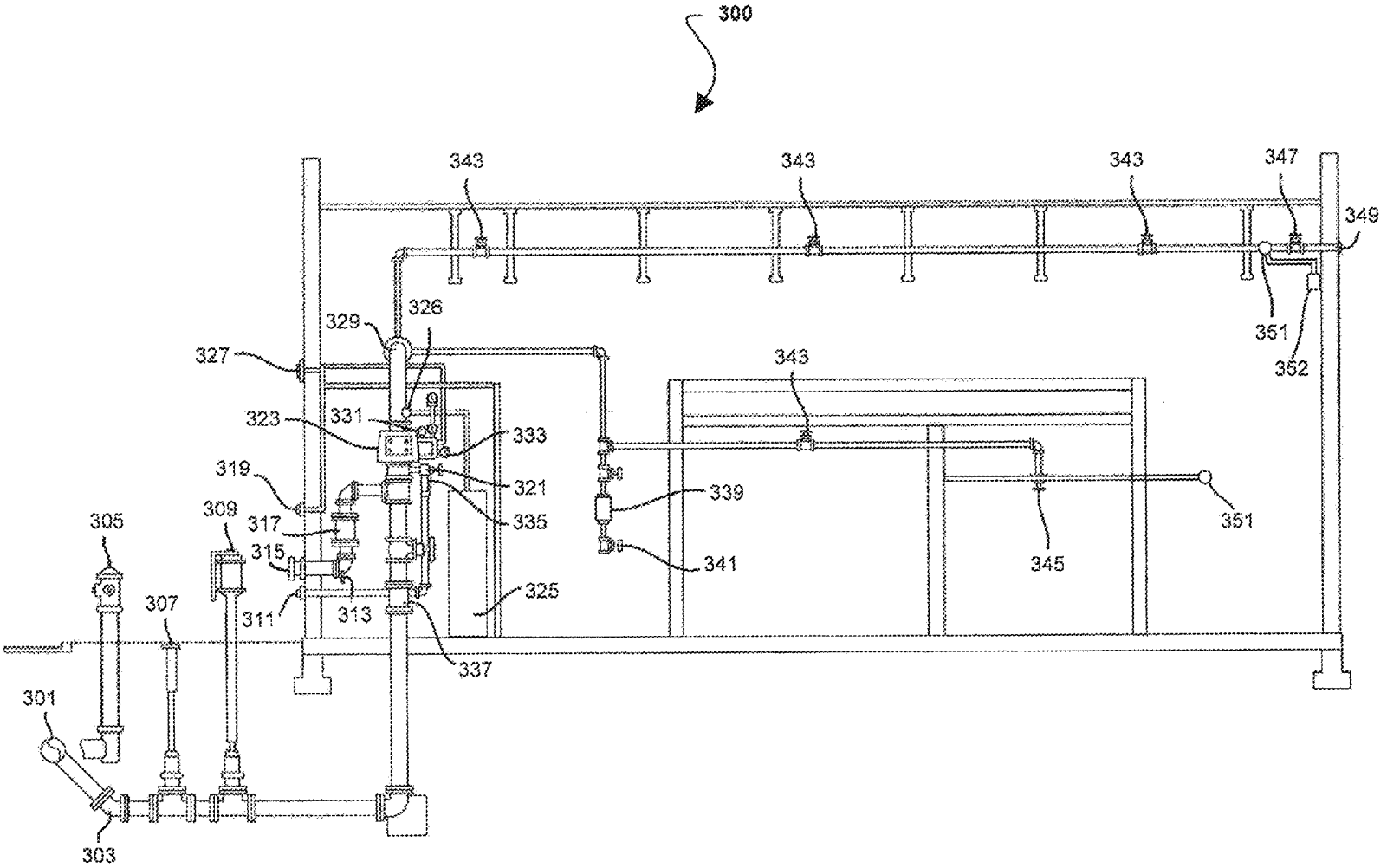
FIG. 3 illustrates an embodiment of a fire protection system comprising a dry pipe sprinkler system having a controlled discharge gas vent constructed according to the present disclosure.

With reference to FIG. 3, a dry pipe fire protection system operable to perform one or more breathing cycle is shown 300. A city main 301 provides pressurized water to the underground fire main 303 and to a fire hydrant 305. A key valve 307 is used to control flow of water into the underground fire main 303 and a post indicator valve 309 indicates water flow is available to the system. The system also includes a test drain 311, a ball drip 313, and a fire department connection 315. A check valve 317 positioned near the fire department connection 315 prevents backflow from the system back into the fire department connection. A water motor alarm drain 319 runs from the water motor alarm 327 and a test drain valve 321 controls flow to the test drain 311.

A dry pipe valve 323 controls pressurized water flow from the underground fire main 303 to the cross main 329 and the piping network in response to pressurized nitrogen within the piping network. A nitrogen generator 325 is connected past the dry pipe valve 323 on the cross main 329 and piping network side and uses a check valve 326 to prevent backflow into the nitrogen generator 325. A pressure maintenance device 331 is used to measure nitrogen pressure in the piping network. An alarm test valve 333 and drain cup 335 can be used for testing. Another check valve 337 is positioned to prevent backflow from the system into the underground fire main 303. A drum drip 339 and drain valve and plug 341 are positioned in the piping network.

One or more upright sprinklers 343 and pendent sprinklers 345 are positioned and spaced within the piping network to provide fire protection coverage. An inspector's test valve 347 and an inspector's test drain 349 are positioned at a terminal portion of the piping network to allow testing and purging of the system. One or more controlled discharge gas vents 351 are positioned close to ends of piping network lines, for example, near the inspector's test valve 347 and inspector's test drain 349, adjacent to system vents and at other terminal portions of the piping network. The controlled discharge gas vents 351 are coupled to a sensor 352, such as an oxygen sensor and/or humidity sensor, which is used to measure exhaust gas from within the system to ensure all oxygen and/or water vapor or an acceptable level of oxygen and/or water vapor is purged from the system.

The embodiments and the examples described herein are exemplary and not intended to be limiting in describing the full scope of apparatus, systems, and methods of the present technology. Equivalent changes, modifications and variations of some embodiments, materials, compositions and methods can be made within the scope of the present technology, with substantially similar results.

The embodiments of the invention in which an exclusive property or privilege is claimed are defined as follows:

1. A controlled discharge gas vent for a dry pipe or preaction fire sprinkler system, the controlled discharge gas vent comprising:

a liquid sensing valve;

an adjustable back pressure regulator having an adjustable threshold pressure; and an orifice operable to provide a flow rate of gas therethrough;

wherein the liquid sensing valve is adapted to allow gas discharge but not liquid discharge from a piping network when the liquid sensing valve is coupled to the piping network; and wherein the adjustable back pressure regulator is operable to open when a pressure in the piping network exceeds the adjustable threshold pressure and close when the pressure in the piping network is below the adjustable threshold pressure.

2. The controlled discharge gas vent of claim 1 further comprising a gas sampling port.

3. The controlled discharge gas vent of claim 1 further comprising an in-line filter.

4. The controlled discharge gas vent of claim 1 further comprising an isolation ball valve.

5. The controlled discharge gas vent of claim 1 further comprising a Y-strainer.

6. The controlled discharge gas vent of claim 1 further comprising a muffler.

7. The controlled discharge gas vent of claim 1 wherein the liquid sensing valve comprises an electric liquid sensing control unit.

8. The controlled discharge gas vent of claim 1 wherein the liquid sensing valve comprises a float valve.

9. The controlled discharge gas vent of claim 8 further comprising a gas sampling port.

10. The controlled discharge gas vent of claim 9 further comprising an in-line filter.

11. The controlled discharge gas vent of claim 10 further comprising an isolation ball valve.

12. The controlled discharge gas vent of claim 11 further comprising a Y-strainer.

13. A dry pipe or preaction fire protection system comprising:

a sprinkler system including at least one sprinkler, a source of pressurized water, a piping network connecting the at least one sprinkler to the source of pressurized water, and a controlled discharge gas vent according to claim 1; and a source of pressurized nitrogen coupled to the sprinkler system.

14. The fire protection system of claim 13 wherein the source of pressurized nitrogen includes a nitrogen generator.

15. A water-based fire protection system comprising:

a dry pipe or preaction sprinkler system comprising at least one sprinkler, a source of pressurized water, a piping network connected to the at least one sprinkler, and a dry pipe or preaction valve coupling the source of pressurized water to the piping network;

a source of pressurized nitrogen coupled to the piping network, the source of pressurized nitrogen operable to pressurize the piping network with nitrogen until the water-based fire protection system is actuated; and at least one controlled discharge gas vent positioned within the piping network, the at least one controlled discharge gas vent operable to allow gas including oxygen displaced by the nitrogen to exit the piping network while preventing liquid from exiting the piping network and maintaining enough pressure within the system to prevent the dry pipe or preaction valve from opening until the water-based fire protection system is actuated to thereby increase the concentration of nitrogen and decrease the concentration of oxygen in the piping network to reduce or eliminate the rate of corrosion in the piping network.

16. The fire protection system of claim 15 wherein the at least one controlled discharge gas vent comprises a gas sampling port.

17. The fire protection system of claim 15 wherein the at least one controlled discharge gas vent comprises an in-line filter.

18. The fire protection system of claim 15 wherein the at least one controlled discharge gas vent comprises an isolation ball valve.

19. The fire protection system of claim 15 wherein the at least one controlled discharge gas vent comprises a Y-strainer.

20. The fire protection system of claim 15 wherein the at least one controlled discharge gas vent comprises a muffler.

21. The fire protection system of claim 15 wherein the source of pressurized nitrogen comprises a nitrogen generator.

22. The fire protection system of claim 15 wherein the at least one controlled discharge gas vent comprises an oxygen sensor.

23. The fire protection system of claim 15 wherein the at least one controlled discharge gas vent comprises an orifice.

24. The fire protection system of claim 15 wherein the at least one controlled discharge gas vent includes a back pressure regulator.

25. The fire protection system of claim 24 wherein the back pressure regulator comprises an adjustable back pressure regulator having an adjustable threshold pressure.

26. The fire protection system of claim 15, wherein the at least one controlled discharge gas vent includes a liquid sensing valve.

27. The fire protection system of claim 26 wherein the liquid sensing valve comprises an electric liquid sensing control unit.

28. The fire protection system of claim 26 wherein the liquid sensing valve comprises a float valve.

29. The fire protection system of claim 26 wherein the at least one controlled discharge gas vent includes an orifice.

30. The fire protection system of claim 29 wherein the at least one controlled discharge gas vent includes a gas sampling port.

31. The fire protection system of claim 30 wherein the at least one controlled discharge gas vent includes an oxygen sensor.

32. The fire protection system of claim 29 wherein the at least one controlled discharge gas vent includes a Y-strainer.

33. The fire protection system of claim 32 wherein the at least one controlled discharge gas vent includes an isolation ball valve.

34. The fire protection system of claim 26 wherein the at least one controlled discharge gas vent includes a back pressure regulator.

35. The fire protection system of claim 34 wherein the at least one controlled discharge gas vent comprises a gas sampling port.

36. The fire protection system of claim 35 wherein the at least one controlled discharge gas vent includes an orifice.

37. The fire protection system of claim 36 wherein the back pressure regulator comprises an adjustable back pressure regulator having an adjustable threshold pressure.

38. The fire protection system of claim 37 wherein the liquid sensing valve comprises a float valve.

39. The fire protection system of claim 38 wherein the at least one controlled discharge gas vent comprises an in-line filter.

40. The fire protection system of claim 39 wherein the at least one controlled discharge gas vent comprises an isolation ball valve.

41. The fire protection system of claim 40 wherein the at least one controlled discharge gas vent comprises a Y-strainer.

42. The fire protection system of claim 41 wherein the at least one controlled discharge gas vent comprises a muffler.

* * * * *